US011634916B2

(12) United States Patent
Alvetro et al.

(10) Patent No.: US 11,634,916 B2
(45) Date of Patent: Apr. 25, 2023

(54) STAIR STEP JIG ASSEMBLY

(71) Applicants: Guy Alvetro, Reynoldsville, PA (US); Crystal Alvetro, Reynoldsville, PA (US)

(72) Inventors: Guy Alvetro, Reynoldsville, PA (US); Crystal Alvetro, Reynoldsville, PA (US)

( * ) Notice: Subject to any disclaimer, the term of this patent is extended or adjusted under 35 U.S.C. 154(b) by 268 days.

(21) Appl. No.: 17/183,479

(22) Filed: Feb. 24, 2021

(65) Prior Publication Data

US 2022/0268034 A1 Aug. 25, 2022

(51) Int. Cl.
*E04F 21/26* (2006.01)
*E04F 21/24* (2006.01)
*E04F 11/17* (2006.01)

(52) U.S. Cl.
CPC ..... *E04F 21/241* (2013.01); *E04F 11/17* (2013.01); *E04F 21/26* (2013.01)

(58) Field of Classification Search
CPC ..... E04F 11/17; E04F 21/241; E04F 21/26
See application file for complete search history.

(56) References Cited

U.S. PATENT DOCUMENTS 772,597 A * 10/1904 Williamson ..... E04F 21/241 404/97
1,548,452 A 8/1925 Fyhrie
1,831,693 A * 11/1931 Trotter ..... B43L 7/10 33/420
3,373,458 A 3/1968 Haivala
3,947,916 A 4/1976 Mitchell
5,906,455 A 5/1999 McLaughlin
7,350,306 B2 * 4/2008 Reed ..... B43L 7/02 33/420
8,122,609 B2 * 2/2012 Farr ..... E04F 21/0076 33/420
9,011,040 B1 4/2015 Canepa
2007/0061989 A1 3/2007 Kalbach
2012/0285028 A1 * 11/2012 Atwood ..... G01B 3/02 33/452
2015/0233131 A1 * 8/2015 Hofstetter ..... E04F 21/26 33/427

FOREIGN PATENT DOCUMENTS

EP 0662549 A1 * 7/1995

* cited by examiner

*Primary Examiner* — Gary S Hartmann

(57) ABSTRACT

A stair step jig assembly for smoothing treads on concrete steps includes a jig that is elongated to a predetermined length to extend along a full length of a tread on a concrete step for smoothing the tread before the concrete has cured. A riser adjustment is hingedly coupled to the jig and the riser adjustment unit abuts a concrete form that is positioned against the riser of the step adjacent to the tread upon which the jig is positioned. A leg is hingedly coupled to the jig and the leg slidably engages the riser adjustment such that each of the leg, the riser adjustment and the jig forms a triangle. The leg has engages a top of the riser of the step adjacent to tread upon which the jig is positioned for keeping the jig at a fixed angle on the tread.

12 Claims, 7 Drawing Sheets

STAIR STEP JIG ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to jig devices and more particularly pertains to a new jig device for smoothing treads on concrete steps. The device includes a riser adjustment that has a slidably adjustable height to accommodate riser heights between 5.0 inches and 8.0 inches. Additionally, the device includes a leg that rests on top of the riser for maintaining a jig at a fixed angle for finishing the tread.

(2) Description of Related Art Including Information Disclosed Under 37 CFR 1.97 and 1.98

The prior art relates to jig devices and more particularly pertains to a new jig device for smoothing treads on concrete steps. The prior art discloses a variety of jig devices that includes an arcuate jig for forming planes that intersect at a curve. The prior art discloses a masonry step jig that includes a wheel for rolling on top of a riser and the jig that is engaged to the wheel for smoothing a tread on a step. The prior art discloses a stair screed that includes a sloped portion that is insertable under a form on a riser adjacent to a tread being smoothed. Additionally, the prior art discloses a jig that has a riser adjustment being coupled there to which rides on top of a riser adjacent to a tread being smoothed with the jig.

BRIEF SUMMARY OF THE INVENTION

An embodiment of the disclosure meets the needs presented above by generally comprising a jig that is elongated to a predetermined length to extend along a full length of a tread on a concrete step for smoothing the tread before the concrete has cured. A riser adjustment is hingedly coupled to the jig and the riser adjustment unit abuts a concrete form that is positioned against the riser of the step adjacent to the tread upon which the jig is positioned. A leg is hingedly coupled to the jig and the leg slidably engages the riser adjustment such that each of the leg, the riser adjustment and the jig forms a triangle. The leg has engages a top of the riser of the step adjacent to tread upon which the jig is positioned for keeping the jig at a fixed angle on the tread.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
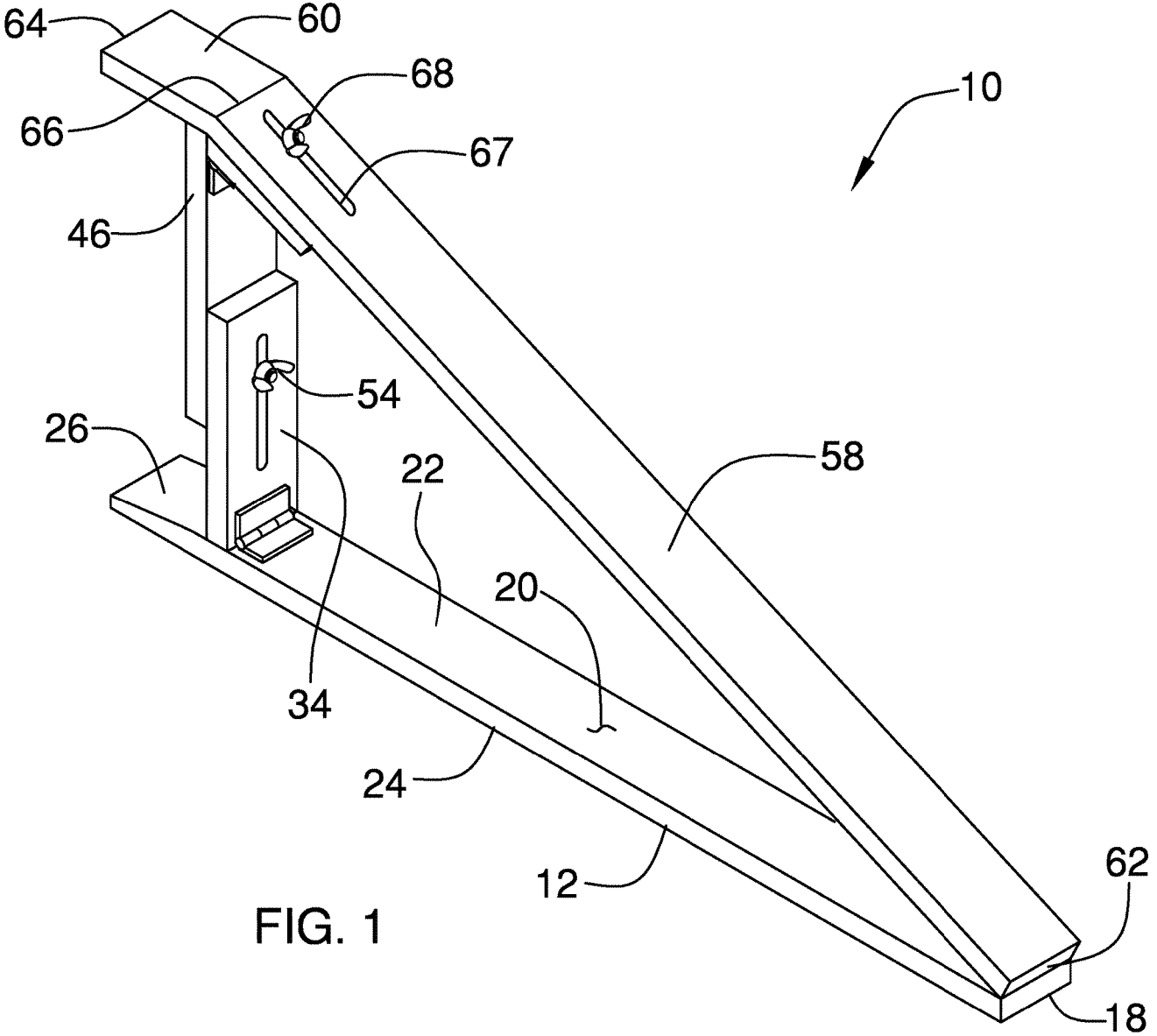
FIG. 1 is a front perspective view of a stair step jig assembly according to an embodiment of the disclosure.
Figure 2:
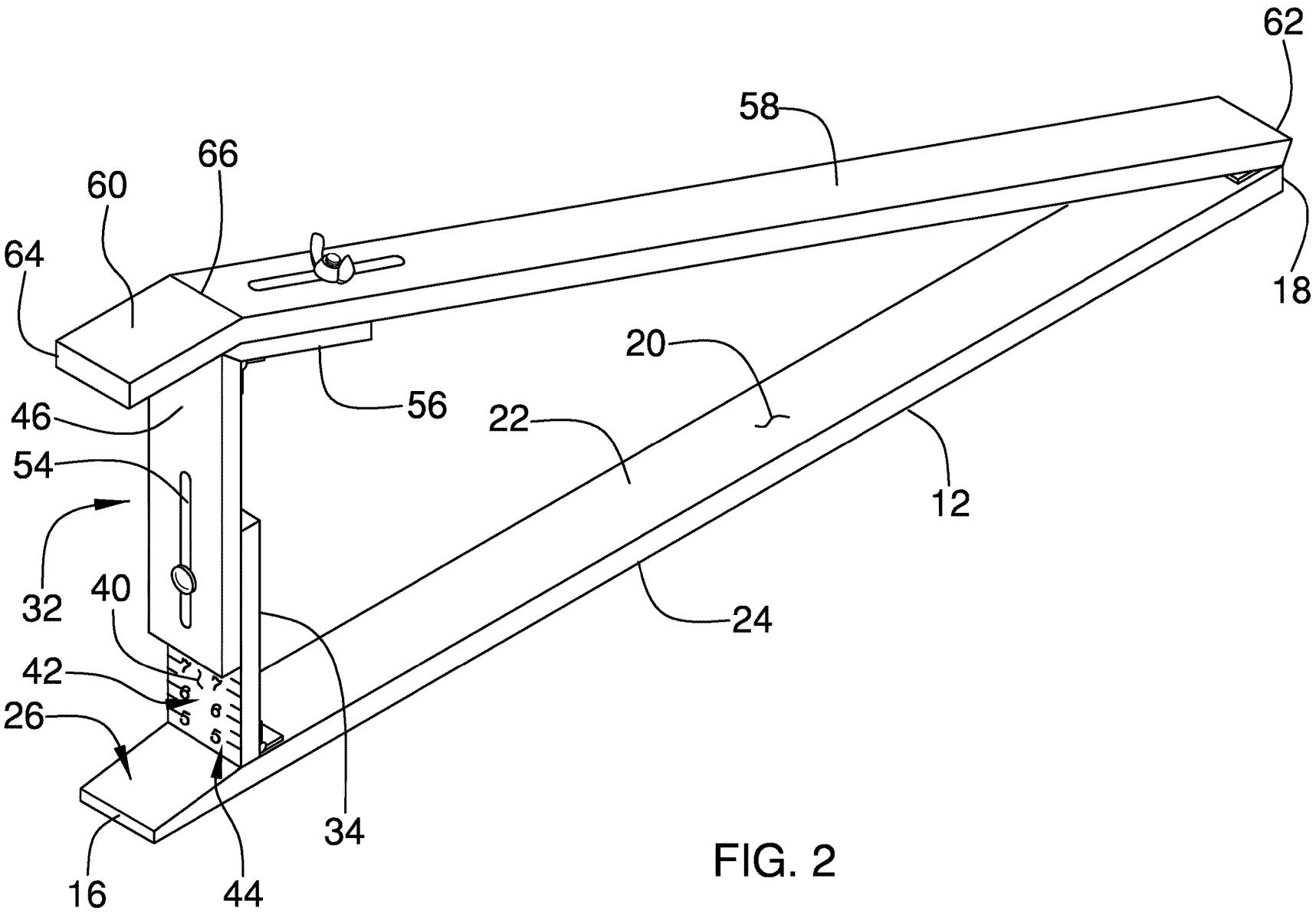
FIG. 2 is a back perspective view of an embodiment of the disclosure.
Figure 3:
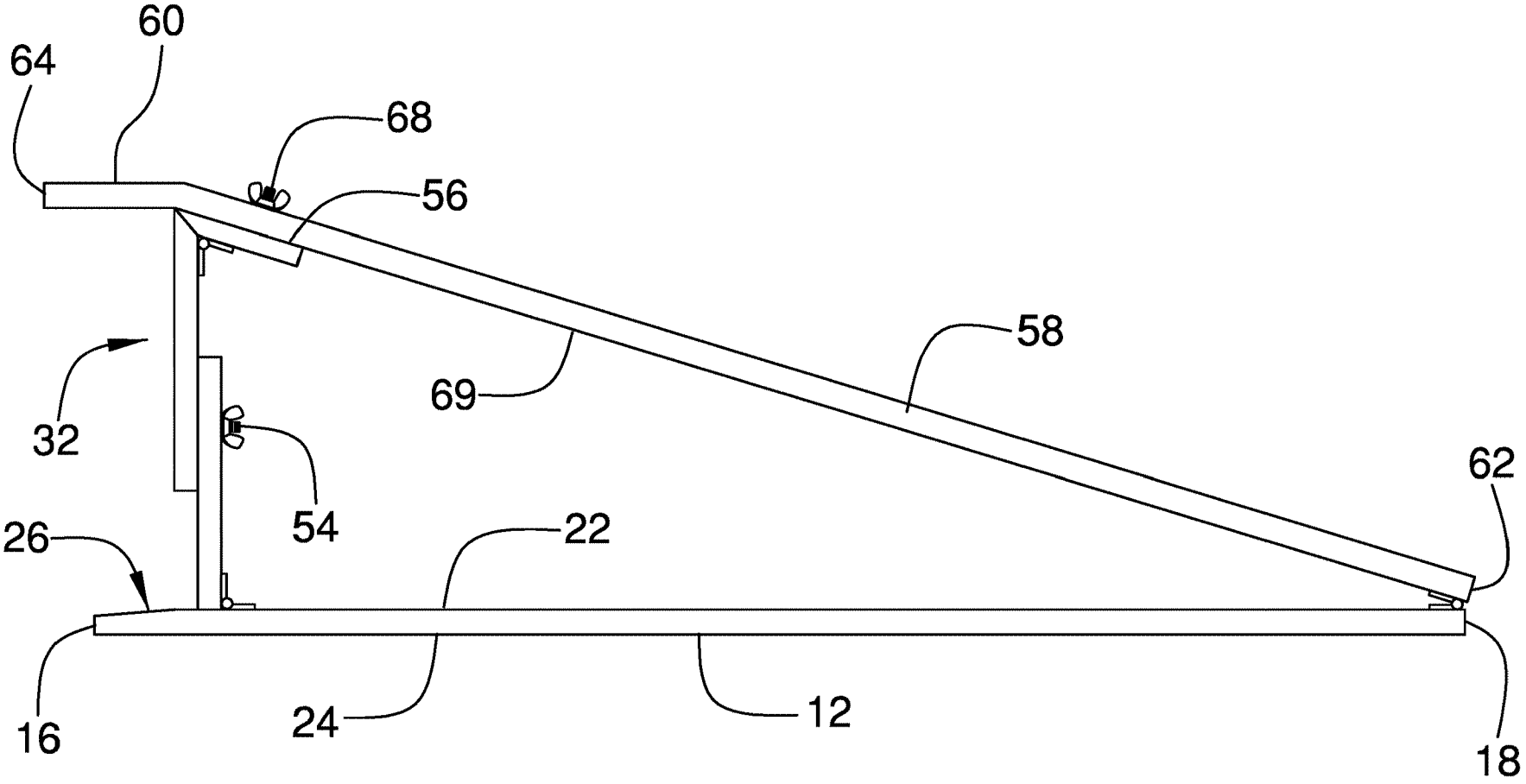
FIG. 3 is a right side view of an embodiment of the disclosure.
Figure 4:
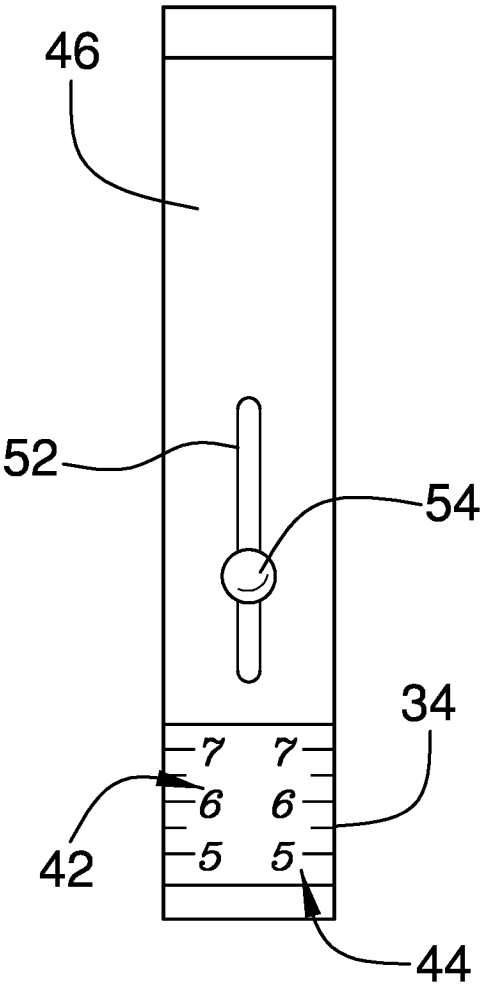
FIG. 4 is a back view of an embodiment of the disclosure.
Figure 5:
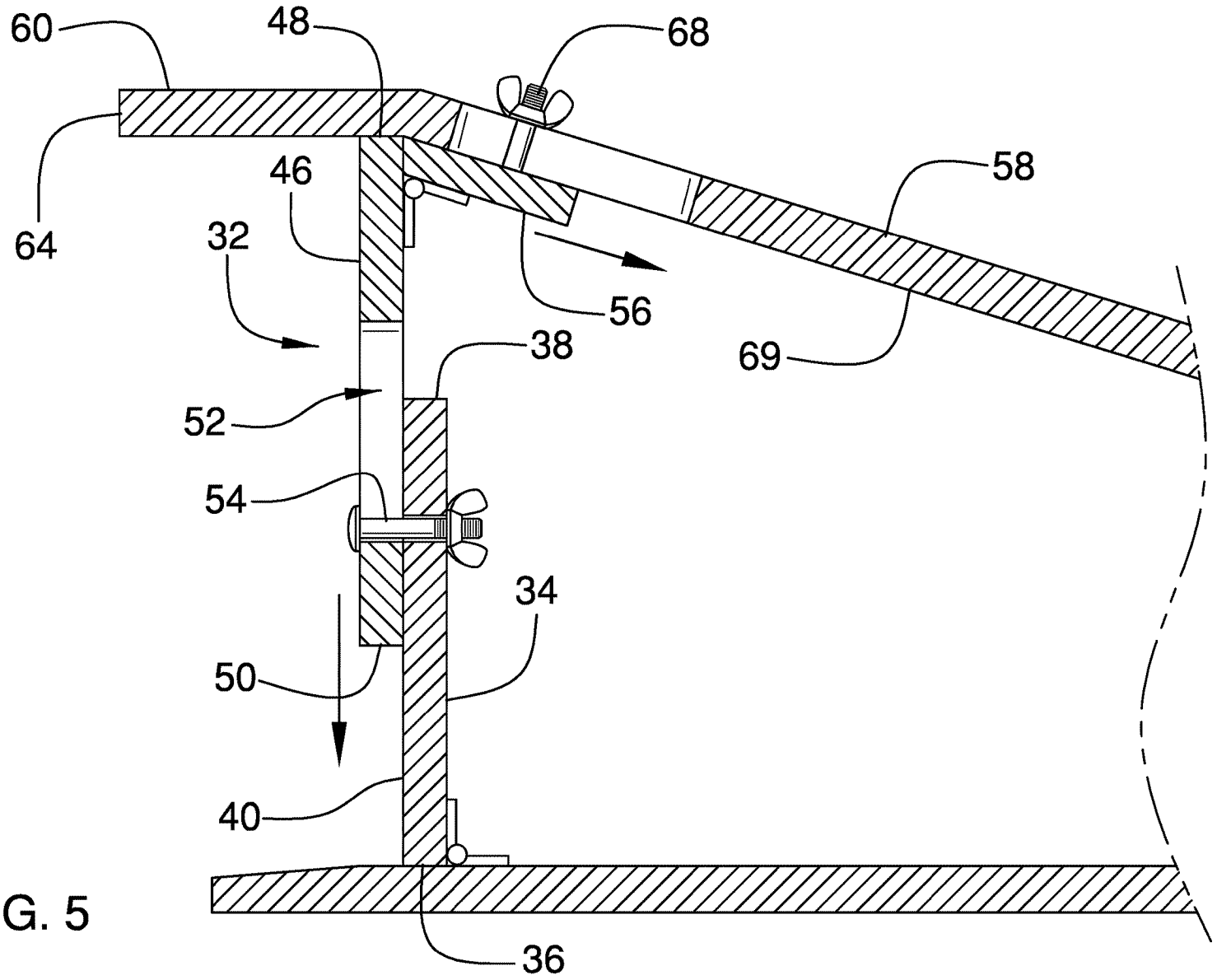
FIG. 5 is a right side cut-away view of an embodiment of the disclosure.
Figure 6:
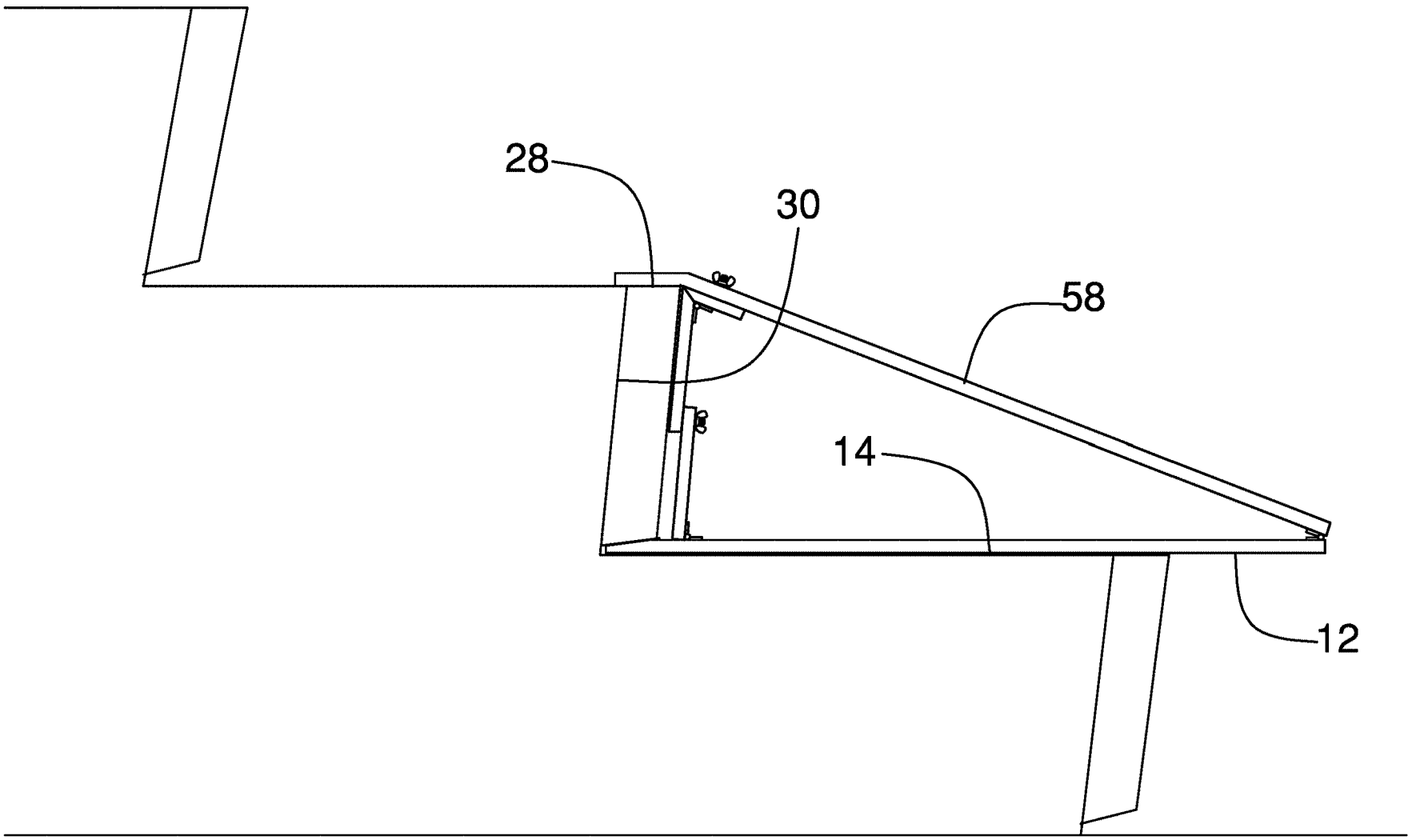
FIG. 6 is a perspective in-use view of an embodiment of the disclosure.
Figure 7:
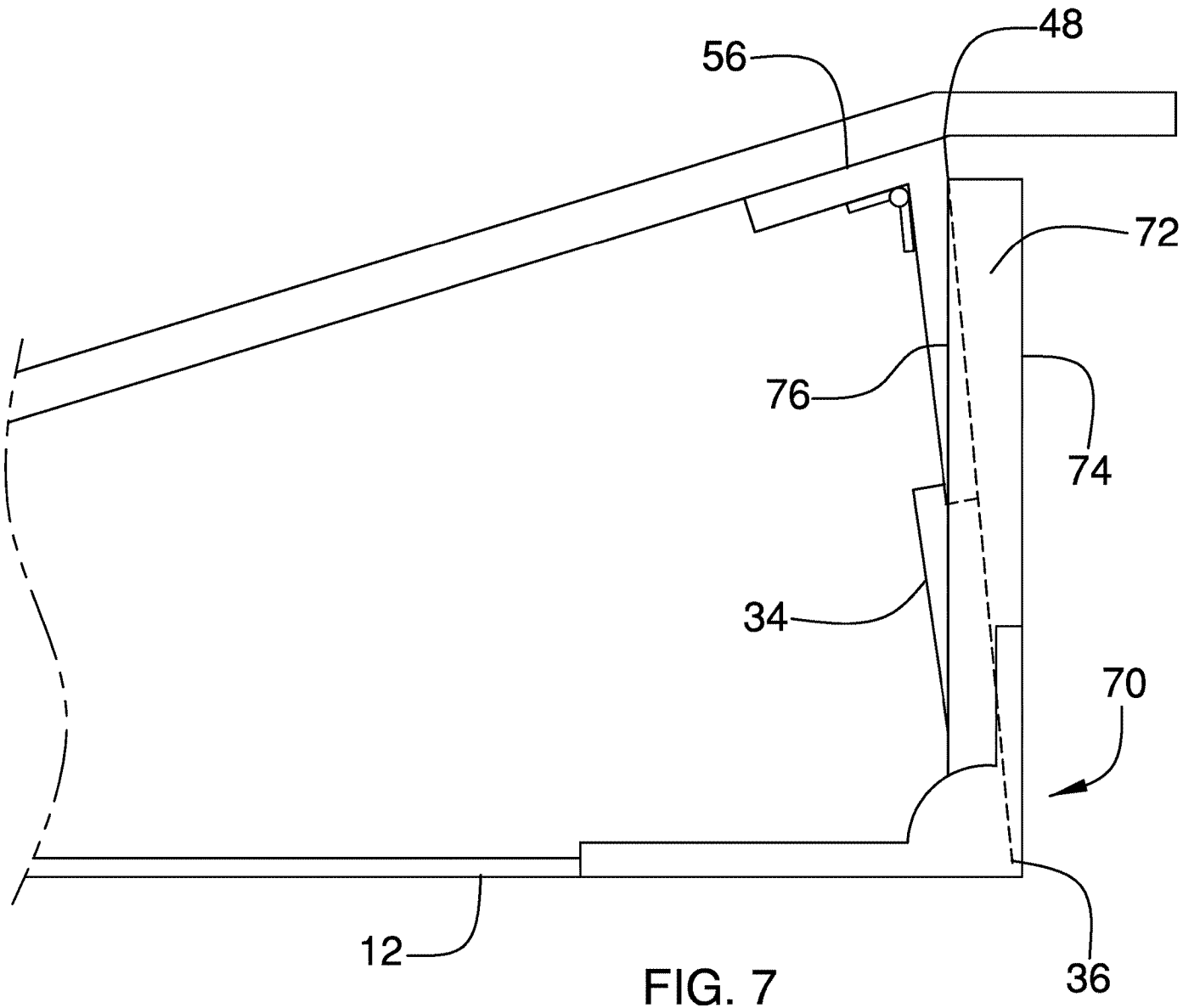
FIG. 7 is a perspective in-use view of an embodiment of the disclosure showing a frame square being employed to adjust a riser adjustment.

With reference now to the drawings, and in particular to FIGS. 1 through 7 thereof, a new jig device embodying the principles and concepts of an embodiment of the disclosure and generally designated by the reference numeral 10 will be described.

As best illustrated in FIGS. 1 through 7, the stair step jig assembly 10 generally comprises a jig 12 that is elongated to a predetermined length. In this way the jig 12 can extend along a full length of a tread 14 on a concrete step for smoothing the tread 14 before the concrete has cured. The jig 12 has a first end 16, a second end 18 and an outer surface 20 extending therebetween. The jig 12 is elongated between the first end 16 and the second end 18 and the jig 12 may have a length of at least 19.0 inches. The outer surface 20 has a top side 22 and a bottom side 24, and the bottom side 24 can rest upon the tread 14 of the concrete step. The top side 22 has a sloped portion 26 extending from the first end 16 toward the second end 18, and the sloped portion 26 tapers to a point on the first end 16. In this way the sloped portion 26 can extend beneath a concrete form 28 that is positioned against a riser 30 of an adjacent step with respect to the tread 14 upon which the jig 12 is positioned. The sloped portion 26 may have a length of at least 1.5 inches.

A riser adjustment 32 is provided and the riser adjustment 32 is hingedly coupled to the jig 12. The riser adjustment 32 unit abuts the concrete form 28 that is positioned against the riser 30 of the step adjacent with respect to the tread 14 upon which the jig 12 is positioned. Additionally, the riser adjustment 32 has an adjustable height to accommodate a variety of riser 30 heights. The riser adjustment 32 comprises a first portion 34 that has a primary end 36, a secondary end 38 and a back surface 40 extending therebetween. The primary end 36 is hingedly coupled to the top side 22 of the outer surface 20 of the jig 12 at a point located adjacent to the sloped portion 26 of the top side 22. Additionally, the back surface 40 has graduated indicia 42 printed thereon which define a graduated scale 44 extending between the primary end 36 and the secondary end 38. The graduated scale 44 may comprise a ruler measuring between 5.0 inches and 8.0 inches.

The riser adjustment 32 includes a second portion 46 that has an upper end 48 and a lower end 50. The second portion 46 has a slot 52 extending therethrough and the slot 52 extends substantially between the upper end 48 and the lower end 50. A first fastener 54 extends through the slot 52 and engages the back surface 40 of the first portion 34 such that the second portion 46 is slidably coupled to the first portion 34. The first fastener 54 is tightenable for retaining the second portion 46 at a selected height with respect to the first portion 34. The first fastener 54 may comprise a nut and a bolt or other type of releasable, mechanical fastener. Additionally, the riser adjustment 32 includes a foot 56 that is hingedly coupled to the upper end 48 of the second portion 46 having the foot 56 extending forwardly away from the second portion 46.

A leg 58 is provided and the leg 58 is hingedly coupled to the jig 12. Additionally, the leg 58 slidably engages the riser adjustment 32 such that each of the leg 58, the riser adjustment 32 and the jig 12 forms a triangle. The leg 58 has a protrusion 60 extending rearwardly beyond the riser adjustment 32 such that the protrusion 60 can lie on top of the riser 30 of the step adjacent to tread 14 upon which the jig 12 is positioned. In this way the jig 12 can be retained at a fixed angle on the tread 14 for finishing the concrete at a consistent angle. The riser adjustment 32 may be adjustable to a length ranging between approximately 5.0 inches and 8.0 inches. The protrusion 60 may have a length of at least 1.5 inches.

The leg 58 has a front end 62 and a back end 64, and the leg 58 has a bend 66 that is positioned closer to the back end 64 than the front end 62 to define the protrusion 60 between the bend 66 and the back end 64. The leg 58 has a slot 68 extending therethrough and the slot 68 in the leg 58 extends from the bend 66 toward the front end 62. The foot 56 of the riser adjustment 32 abuts a bottom surface 69 of the leg 58 having the foot 56 being aligned with the slot 68 in the leg 58. A second fastener 68 extends through the slot in the leg 58 and engages the foot 56 such that the riser adjustment 32 is slidably coupled to the leg 58. The second fastener 68 is tightenable for retaining the foot 56 at a selected point along the leg 58. Additionally, the second portion 46 of the riser adjustment 32 is aligned with the bend 66 in the leg 58 when the riser adjustment 32 is slid fully rearwardly in the slot in the leg 58.

In use, the riser adjustment 32 is adjusted to the desired height based upon the height of the riser 30 on the staircase being built. The first fastener 54 is tightened to retain the riser adjustment 32 at the desired height. As is most clearly shown in FIG. 7, a framing square 70 is placed against the jig 12 such that the one inch thick ruler 72 on the framing square 70 extends upwardly along the riser adjustment 32. A rear edge 74 of the one inch thick ruler 72 is aligned with the primary end 36 of the first portion 34 of the riser adjustment 32. The foot 56 is slid along the leg 58 until the upper end 48 of the second portion 46 of the riser adjustment 32 is aligned with a front edge 76 of the one inch thick ruler 70. In this way the riser adjustment 32 is angled on the jig 12 to facilitate a one inch set-back for the riser 30. The second fastener 68 is tightened to retain the riser adjustment 32 at the preferred location on the leg 58.

The sloped portion 26 of the jig 12 is inserted beneath the form 28 on the positioned against the riser 30 adjacent to the tread 14 that is being smoothed with the jig 12. Additionally, the protrusion 60 on the leg 58 rests on top of the form 28 positioned against the riser 30. In this way the jig 12 is retained at a consistent angle for smoothing the tread 14 upon which the jig 12 is positioned. Thus, the tread 14 of concrete stairs can be precisely smoothed for the best possible comfort and safety for people that will walk on the concrete stairs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A stair step jig assembly for smoothing treads on concrete steps, said assembly comprising:

a jig being elongated to a predetermined length wherein said jig is configured to extend along a full length of a tread on a concrete step for smoothing the tread before the concrete has cured;

a riser adjustment being hingedly coupled to said jig wherein said riser adjustment unit is configured to abut the concrete form being positioned against the riser of the step adjacent to the tread upon which said jig is positioned, said riser adjustment having an adjustable height wherein said riser adjustment is configured to accommodate a variety of riser heights; and a leg being hingedly coupled to said jig, said leg slidably engaging said riser adjustment such that each of said leg, said riser adjustment and said jig forms a triangle, said leg having a protrusion extending rearwardly beyond said riser adjustment wherein said protrusion is configured to lie on top of the riser of the step adjacent to tread upon which said jig is positioned for keeping said jig at a fixed angle on the tread.

2. The assembly according to claim 1, wherein said jig has a first end, a second end and an outer surface extending therebetween, said jig being elongated between said first end and said second end, said outer surface having a top side and a bottom side wherein said bottom side is configured to rest upon the tread of the concrete step.

3. The assembly according to claim 2, wherein said top side has a sloped portion extending from said first end toward said second end, said sloped portion tapering to a point on said first end wherein said sloped portion is configured to extend beneath a concrete form being positioned against a riser of an adjacent step with respect to the tread upon which said jig is positioned.

4. The assembly according to claim 1, wherein said riser adjustment comprises a first portion having a primary end, a secondary end and a back surface extending therebetween, said primary end being hingedly coupled to said top side of said outer surface of said jig at a point located adjacent to said sloped portion of said top side.

5. The assembly according to claim 4, wherein said back surface has graduated indicia being printed thereon defining a graduated scale extending between said primary end and said secondary end.

6. The assembly according to claim 4, wherein said riser adjustment comprises a second portion having an upper end and a lower end, said second portion having a slot extending therethrough, said slot extending substantially between said upper end and said lower end.

7. The assembly according to claim 6, further comprising a first fastener extending through said slot and engaging said back surface of said first portion such that said second portion is slidably coupled to said first portion, said first fastener being tightenable for retaining said second portion at a selected height with respect to said first portion.

8. The assembly according to claim 6, wherein said riser adjustment includes a foot being hingedly coupled to said upper end of said second portion having said foot extending forwardly away from said second portion.

9. The assembly according to claim 1, wherein said leg has a front end and a back end, said leg having a bend being positioned closer to said back end than said front end to define said protrusion between said bend and said back end, said leg having a slot extending therethrough, said slot in said leg extending from said bend toward said front end.

10. The assembly according to claim 9, wherein:

said riser adjustment includes a first portion slidably engaging a second portion, said riser adjustment including a foot being hingedly coupled to said second portion; and said foot of said riser adjustment abuts a bottom surface of said leg having said foot being aligned with said slot in said leg.

11. The assembly according to claim 7, further comprising a second fastener extending through said slot in said leg and engaging said foot such that said riser adjustment is slidably coupled to said leg, said second fastener being tightenable for retaining said foot at a selected point along said leg, said second portion of said riser adjustment being aligned with said bend in said leg when said riser adjustment is slid fully rearwardly in said slot in said leg.

12. A stair step jig assembly for smoothing treads on concrete steps, said assembly comprising:

a jig being elongated to a predetermined length wherein said jig is configured to extend along a full length of a tread on a concrete step for smoothing the tread before the concrete has cured, said jig having a first end, a second end and an outer surface extending therebetween, said jig being elongated between said first end and said second end, said outer surface having a top side and a bottom side wherein said bottom side is configured to rest upon the tread of the concrete step, said top side having a sloped portion extending from said first end toward said second end, said sloped portion tapering to a point on said first end wherein said sloped portion is configured to extend beneath a concrete form being positioned against a riser of an adjacent step with respect to the tread upon which said jig is positioned;

a riser adjustment being hingedly coupled to said jig wherein said riser adjustment unit is configured to abut the concrete form being positioned against the riser of the step adjacent to the tread upon which said jig is positioned, said riser adjustment having an adjustable height wherein said riser adjustment is configured to accommodate a variety of riser heights, said riser adjustment comprising:

a first portion having a primary end, a secondary end and a back surface extending therebetween, said primary end being hingedly coupled to said top side of said outer surface of said jig at a point located adjacent to said sloped portion of said top side, said back surface having graduated indicia being printed thereon defining a graduated scale extending between said primary end and said secondary end;

a second portion having an upper end and a lower end, said second portion having a slot extending therethrough, said slot extending substantially between said upper end and said lower end;

a first fastener extending through said slot and engaging said back surface of said first portion such that said second portion is slidably coupled to said first portion, said first fastener being tightenable for retaining said second portion at a selected height with respect to said first portion; and a foot being hingedly coupled to said upper end of said second portion having said foot extending forwardly away from said second portion;

a leg being hingedly coupled to said jig, said leg slidably engaging said riser adjustment such that each of said leg, said riser adjustment and said jig forms a triangle, said leg having a protrusion extending rearwardly beyond said riser adjustment wherein said protrusion is configured to lie on top of the riser of the step adjacent to tread upon which said jig is positioned for keeping said jig at a fixed angle on the tread, said leg having a front end and a back end, said leg having a bend being positioned closer to said back end than said front end to define said protrusion between said bend and said back end, said leg having a slot extending therethrough, said slot in said leg extending from said bend toward said front end, said foot of said riser adjustment abutting a bottom surface of said leg having said foot being aligned with said slot in said leg; and a second fastener extending through said slot in said leg and engaging said foot such that said riser adjustment is slidably coupled to said leg, said second fastener being tightenable for retaining said foot at a selected point along said leg, said second portion of said riser adjustment being aligned with said bend in said leg when said riser adjustment is slid fully rearwardly in said slot in said leg.

* * * * *